US009926047B2

(12) United States Patent
Borel et al.

(10) Patent No.: US 9,926,047 B2
(45) Date of Patent: Mar. 27, 2018

(54) TOWING DEVICE WITH A TWO-PIECE FAIRLEAD

(71) Applicant: THALES, Courbevoie (FR)

(72) Inventors: Christophe Borel, Brest (FR); Olivier Cosson, Plouarzel (FR)

(73) Assignee: THALES, Courbevoie (FR)

( * ) Notice: Subject to any disclaimer, the term of this patent is extended or adjusted under 35 U.S.C. 154(b) by 0 days.

(21) Appl. No.: 14/909,581

(22) PCT Filed: Jul. 30, 2014

(86) PCT No.: PCT/EP2014/066359

§ 371 (c)(1),
(2) Date: Feb. 2, 2016

(87) PCT Pub. No.: WO2015/014886

PCT Pub. Date: Feb. 5, 2015

(65) Prior Publication Data

US 2016/0185426 A1 Jun. 30, 2016

(30) Foreign Application Priority Data

Aug. 2, 2013 (FR) ..... 13 01860

(51) Int. Cl.

| | |
|---|---|
| ***B63B 21/10*** | (2006.01) |
| ***B63B 21/16*** | (2006.01) |
| ***B63B 21/66*** | (2006.01) |

(52) U.S. Cl.

CPC ..... *B63B 21/10* (2013.01); *B63B 21/16* (2013.01); *B63B 21/66* (2013.01)

(58) Field of Classification Search

CPC ..... B63B 21/10; B63B 21/16; B63B 21/66

See application file for complete search history.

(56) References Cited

U.S. PATENT DOCUMENTS

| | | | | |
|---|---|---|---|---|
| 3,347,526 | A | 10/1967 | Cymmer et al. | |
| 3,892,386 | A * | 7/1975 | Hogan | B66D 1/36 114/254 |
| 9,682,749 | B2 * | 6/2017 | Borel | B63B 21/66 |
| 2014/0326170 | A1 | 11/2014 | Borel | |

FOREIGN PATENT DOCUMENTS

| | | | |
|---|---|---|---|
| FR | 2982579 | A1 | 5/2013 |
| JP | H09301261 | A | 11/1997 |

* cited by examiner

*Primary Examiner* — Ajay Vasudeva
(74) *Attorney, Agent, or Firm* — Baker & Hostetler LLP

(57) ABSTRACT

A towing device intended to equip the deck of a ship (10) and comprising a winch (16), a cable (14) and a fairlead (20), the cable (14) circulating in the fairlead (20) under the action of the winch (16), the fairlead (20) comprising a frame (21) and at least one first and one second sectors, the sectors making it possible to guide the cable (14) in a channel formed in each of the sectors. The device comprises an articulation with a degree of freedom allowing the rotation of the second sector relative to the frame (21) about an axis contained in a plane comprising a first direction in which the cable can extend in the first sector, characterized in that the first sector is secured to the frame (21) and is interposed between the winch (16) and the second sector.

21 Claims, 12 Drawing Sheets

TOWING DEVICE WITH A TWO-PIECE FAIRLEAD

CROSS-REFERENCE TO RELATED APPLICATIONS

This application is a National Stage of International patent application PCT/EP2014/066359, filed on Jul. 30, 2014, which claims priority to foreign French patent application No. FR 1301860, filed on Aug. 2, 2013, the disclosures of which are incorporated by reference in their entirety.

FIELD OF THE INVENTION

The invention relates to a towing device intended to equip the deck of a ship and making it possible to tow an object dragged behind the ship. The towing device conventionally comprises a winch, a cable and a fairlead, the cable circulating in the fairlead under the action of the winch. This type of device is for example implemented in the field of underwater acoustics and more particularly for towed active sonars. These sonars generally comprise an emitting antenna integrated in a submersible object or "fish" and a receiving antenna consisting of a linear antenna or "flute". When the sonar is being used in dependent towing mode, the fish and the flute are secured to the same cable to be towed by the ship.

BACKGROUND

The cable generally comprises a core formed from electrical and/or optical conductors making it possible to transmit energy and information between the equipment items of the sonar situated onboard the ship and the antennas. The core of the cable is generally covered with a bundle of metal wires ensuring the mechanical strength of the cable. The construction of the cable imposes upon it a minimum radius of airvature. Below this radius, unacceptable mechanical stresses occur and result in damage to these elements. The same applies for the towed antennas of linear antenna type. The winch fixed onto the deck of the ship has a reel on which the cable can be wound when the sonar is inactive and the antennas are stowed onboard the ship. The diameter of the reel makes it possible to guarantee that the wound elements are not bent by a radius less than the minimum radius of airvature.

When the towed elements are at sea, the cable is guided by the fairlead which makes it possible to secure its effective radius of airvature. During the towing, the ship can alter its speed and its heading. Other involuntary movements of the ship may occur when the sea conditions deteriorate, notably in bad weather. These movements of the ship result in a change of direction of the cable relative to the axis of the ship. To prevent changes of direction from damaging the cable, the fairlead can be fixed relative to the ship and have a trumpet form opening out toward the rear of the ship.

Moreover, in underwater acoustics, the fairlead has to be adapted to allow the antennas to be raised onto the deck of the ship. The fairlead is for example open over its top part. The ship can be equipped with an articulated arm making it possible to pass the fish over the fairlead.

The existing devices are bulky and require an actuator for the movement of the articulated arm. Furthermore, when the fish is passed over the fairlead, it is necessary to implement anti-unrigging systems in order to avoid having the cable to which the towed elements are fixed leave its housing in the fairlead.

From the patent application FR2982579, a solution is known that mitigates the abovementioned drawbacks. This solution consists in providing a fairlead formed from sectors making it possible to guide the cable in a groove. The sectors are linked to one another by articulations with a degree of freedom in rotation about axes of rotation situated in horizontal planes substantially at right angles to a direction in which the cable extends in the fairlead at the articulation. According to one embodiment, the fairlead is linked to a frame intended to be placed on a ship, by means of an articulation with a degree of freedom in rotation about an axis contained in a vertical plane at right angles to the first articulation so as to allow a great amplitude of change of direction of the cable when the ship changes heading. So as to reduce the clearance of the cable in the sector situated on the side of the winch and reduce the problems of bad winding of the turns of the cable on the reel, the second axis advantageously cuts the groove of this sector at a point where the cable is designed to enter into contact with the groove on the side of the winch. Now, in practice, a lateral clearance of the cable is noted in the sector situated on the winch side, with the formation of a lateral clearance angle between the fairlead and the winch. This clearance leads to a poor control of the winding of the turns, particularly in the case of a change of heading of the ship.

One aim of the present invention is to mitigate this drawback.

SUMMARY OF THE INVENTION

To this end, the invention proposes a towing device intended to equip the deck of a ship and comprising a winch, a cable and a fairlead, the cable circulating in the fairlead under the action of the winch, the fairlead comprising a frame, at least one first and one second sectors, the sectors making it possible to guide the cable in a channel formed in each of the sectors. The device comprises an articulation with a degree of freedom allowing the rotation of the second sector, called pivoting sector, relative to the frame about an axis contained in a plane comprising a direction in which the cable can extend in the second sector, the first sector, called fixed sector, being secured to the frame and is interposed between the winch and the second sector.

This configuration makes it possible to control the direction of the cable where it leaves the fairlead on the winch side and avoid the turn winding problems.

Advantageously, the first sector comprises a first bottom bearing surface comprising a first end, the second sector comprises a second bottom bearing surface comprising a second end, said cable being able to come to rest on said first and second bearing surfaces, said first end and said second end forming surfaces extending substantially in a joining plane substantially at right angles to the axis.

Advantageously, the first bottom bearing surface and the second bottom bearing surface have semi-circular sections and the axis cuts the joining plane at a point located on a first shaped curve and a second shaped curve formed by the centers of the semi-circular sections of the first bottom bearing surface and, respectively, of the second bottom bearing surface.

Advantageously, the second sector comprises a second bottom bearing surface on which the cable can come to rest, said second bottom bearing surface being of a single piece.

Advantageously, the channel of the second sector has a flared form in a plane comprising the axis and the direction in which the cable can extend in the second sector, the channel of the second sector widening in the direction from the second segment to the first segment.

Advantageously, the channels of said sectors are laterally open.

Advantageously, the channels of said sectors are open toward the bottom of the fairlead.

Advantageously, the device comprises a wire-guiding device, in which the cable passes, the wire-guiding device being interposed between the fairlead and the winch, the winch comprising a reel comprising a drum delimited by two flanges, the channel of the first sector comprising a lateral opening, the opening extending substantially in the extension of one of the two flanges of the reel, the opening being oriented in a direction moving away from the other flange.

Advantageously, the axis is contained in a first plane comprising a direction in which the cable can extend in the first sector.

BRIEF DESCRIPTION OF THE DRAWINGS

The invention will be better understood and other advantages will become apparent on reading the detailed description of an embodiment given by way of example, the description being illustrated by the attached drawing in which.

In the interests of clarity, the same elements will bear the same references in the different figures.

DETAILED DESCRIPTION

The invention is described in relation to the towing of a sonar by a surface vessel. It is clearly understood that the invention can be implemented for other towed elements.

Figure 1:
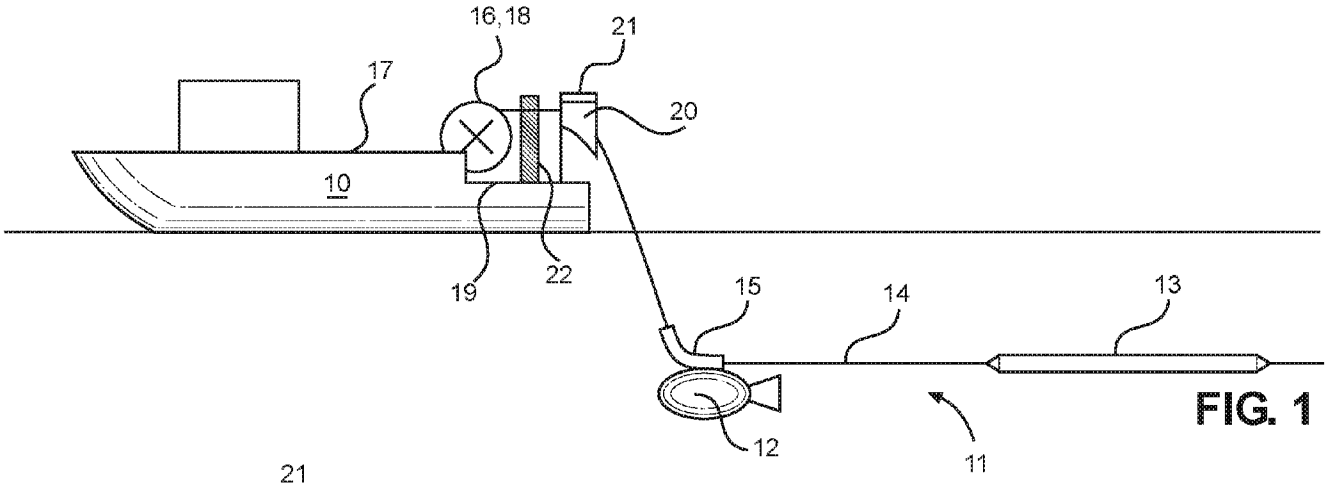
FIG. 1 schematically represents a ship pulling an active sonar.

FIG. 1 represents a ship 10 pulling an active sonar 11 comprising an acoustic emitting antenna 12, often called fish, and an acoustic receiving antenna 13, often called flute. The sonar 11 also comprises a cable 14 making it possible to pull the two antennas 12 and 13. The cable also ensures the routing of signals and power supplies between the ship and the antennas 12 and 13 of the sonar 11.

The antennas 12 and 13 are mechanically moored and electrically and/or optically connected to the cable 14 in an appropriate manner. Conventionally, the receiving antenna 13 is formed from a linear antenna of tubular form identical to those that are found in passive sonars, hence its name of flute, while the emitting antenna 12 is incorporated in a bulky structure that has a form resembling that of a fish. The receiving flute is generally arranged at the rear, at the end of the cable 14, the fish being positioned on the part of the cable 14 closest to the ship 10. During an underwater acoustic mission, the antenna 12 emits sound waves into the water and the receiving antenna 13 picks up any echoes originating from targets on which the sound waves from the antenna 12 are reflected.

The receiving antenna 13 is generally moored permanently to the cable 14 whereas the fish 12, for its part, is moored removably. To this end, the cable 14 comprises a mooring zone 15 for the fish 12, in which zone means are located for mechanically securing the fish 12 and for electrically and/or optically connecting it to the cable 14.

The launching of the antennas 12 and 13 into the water and the removal thereof from the water is done by means of a winch 16 arranged on a deck 17 of the ship 10. As can be seen in FIG. 3, the winch comprises a reel 18 dimensioned to allow for the winding of the cable 14 and of the receiving antenna 13. The winch 16 also comprises a support frame 106 (FIG. 2) intended to be fixed onto the deck of the ship. The reel 18 is able to pivot relative to the support frame 106 about an axis x to allow for the winding of the cable. It comprises a drum 108 around which the cable is intended to be wound. The drum 108 extends, along the axis x of rotation of the drum, between two flanges 109, 110 provided to limit the winding zone of the drum 108. The winding of the cable 14 makes it possible to pull the fish 12 onboard the ship 10, for example onto a rear platform 19 provided for this purpose.

A fairlead 20 makes it possible to guide the cable 14 downstream of the reel 18. The fairlead 20 constitutes the last guiding element for the cable 14 before its descent into the water. During the towing, the inclination of the cable 14 can vary relative to the longitudinal axis of the ship 10. The variations of inclination are notably due to the changes of heading and of speed of the ship and also to the sea conditions. One of the functions of the fairlead 20 is to guarantee for the cable 14 and for the linear antenna that their respective bending radii do not exceed a predefined lower limit. The cable 14 comprises, for example, a core formed from electrical and/or optical conductors making it possible to transmit energy and information between equipment items of the sonar situated onboard the ship 10 and the antennas 12 and 13. The core of the cable 14 is generally covered by a bundle of metal wires ensuring the mechanical strength of the cable 14, notably its pulling strength. Below the lower bending limit, there is a risk of permanent deformation or breakage of the components of the cable 14. The same applies for the linear antenna.

Figure 2:
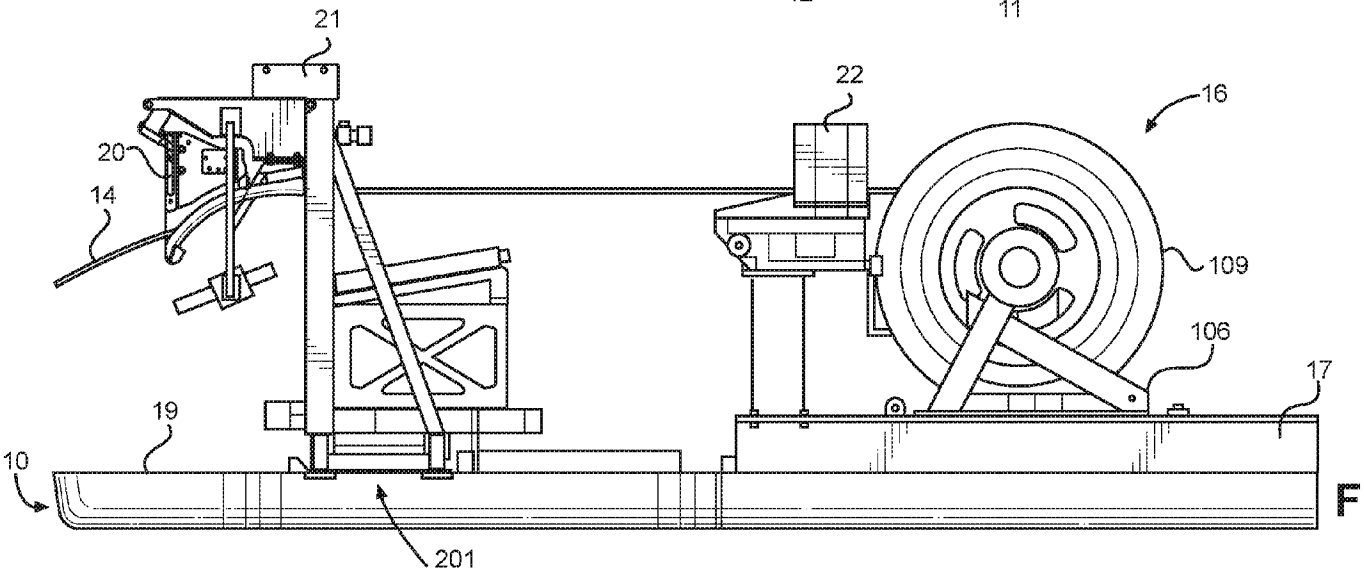
FIG. 2 more specifically represents a device according to the invention installed on the deck of a ship, FIG. 3 schematically represents, in plan view, an exemplary arrangement between a reel, a wire-guiding device and a fairlead of the device according to the invention, FIGS. 4*a*, 4*b* and 4*c* schematically represent a part of the fairlead of the device according to the invention in side view (FIG. 4*a*), in perspective (FIG. 4*b*) and in front view (from the sea side) when the pivoting segment is in its position of equilibrium (FIG. 4*c*), the cable being represented only in FIGS. 4*b* and 4*c*.
Figure 3:
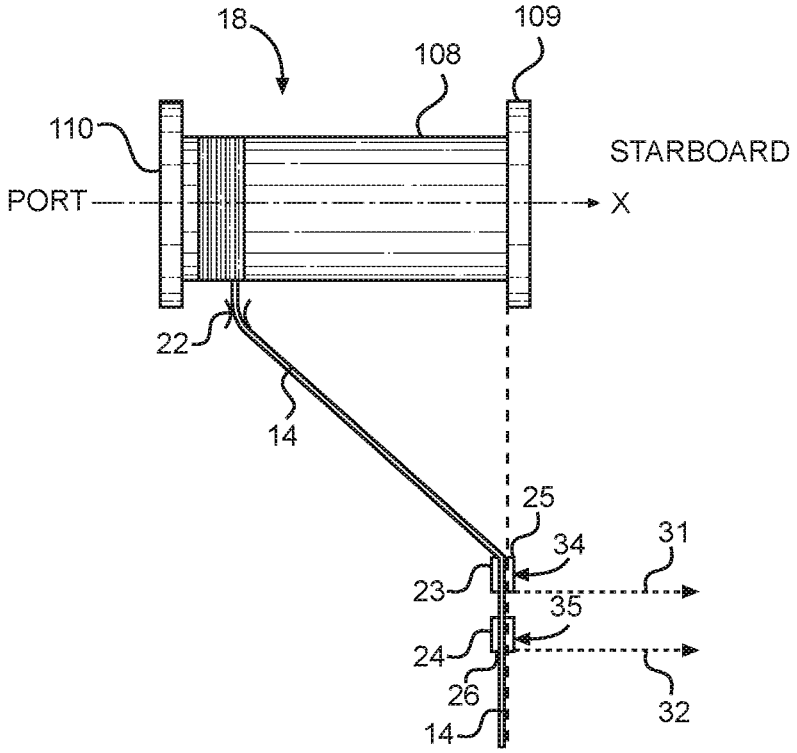

FIG. 2 shows in more detail, in side view (from the starboard side), the elements of the device according to the invention. The fairlead 20 comprises a frame 21 intended to be placed on a deck 19 of the ship, on the sea side relative to the winch 16. The deck 19 is, here, a rear platform. In other words, the fairlead is fixed toward the rear of the ship 10 relative to the winch 16. In the example of FIG. 2, the fairlead is fixed relative to the deck 19 of the ship 10. In the embodiment of the figures, the fairlead 20 and the winch are not fixed onto the same deck but could, as a variant, be arranged on the same deck. The fairlead 20 is linked to the frame 21. A wire-guiding device 22 making it possible to correctly stow the cable 14 on the reel 18 is interposed between the winch 16 and the fairlead 20. The wire-guiding device is intended to be translated along the axis x of rotation of the reel 18 so as to stow the cable correctly on the reel 18. The cable 14 is, here, guided by the wire-guiding device 22 between the fairlead 20 and the winch 16. As a variant, the frame 21 is secured to a wire guide 22. In other words, the frame 21 is fixed to a wire-guiding device intended to perform translational movements parallel to the axis of the reel 18 in order to correctly stow the cable 14 on the reel 18. In the case of the fixing of the frame 21 to the wire guide 22, it is the fairlead 20 as a whole which performs translational movements parallel to the axis of the reel 18 in order to correctly stow the cable 14 on the reel 18.

According to the invention, the fairlead 20 comprises a first sector (or first segment) 23, called fixed sector (or fixed segment) hereinbelow in the patent application, and a second sector (or second segment) 24, called pivoting sector (or pivoting segment), making it possible to guide the cable 14 from upstream to downstream of the fairlead 20. These sectors can be seen in FIGS. 4 *a* and 4 *b*. Each of the sectors 23, 24 comprises a channel or furrows, 25 for the sector 23, 26 for the sector 24. These channels are able to house the cable 14. They make it possible to guide the cable 14 all along the fairlead 20. They are substantially in the extension of one another so as to be able to guide the cable 14 all along the fairlead 20. Each of the sectors 23, 24 allows for a curvature of the cable 14 and of the linear antenna 13. The sectors 23, 24 are dimensioned and arranged so as to limit the minimum curvature of the cable 14 and of the linear antenna 13 to a predetermined minimum curvature. The sectors 23, 24 are dimensioned and arranged so as to allow for a change of direction of the cable 14 in a plane. This change of direction is performed in the plane of FIG. 4 *a*. The fairlead 20 makes it possible to limit the radius of curvature of the cable 14 upon this change of direction. The fairlead makes it possible to avoid having the radius of curvature be less than a predetermined minimum radius of curvature.

Figure 4A:
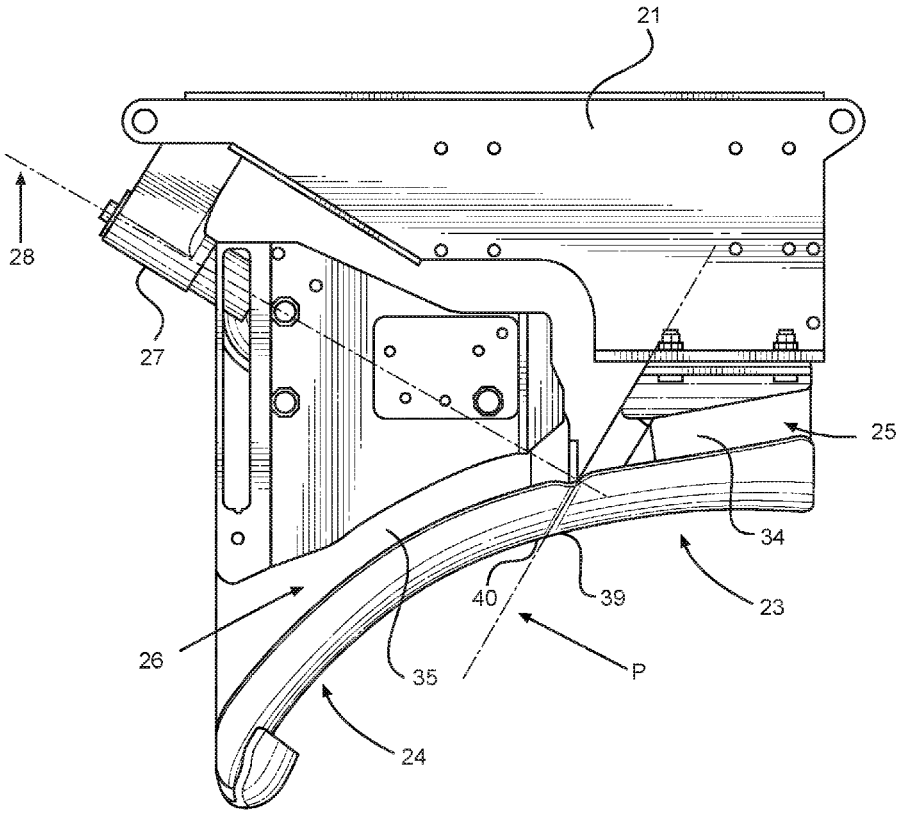
Figure 4B:
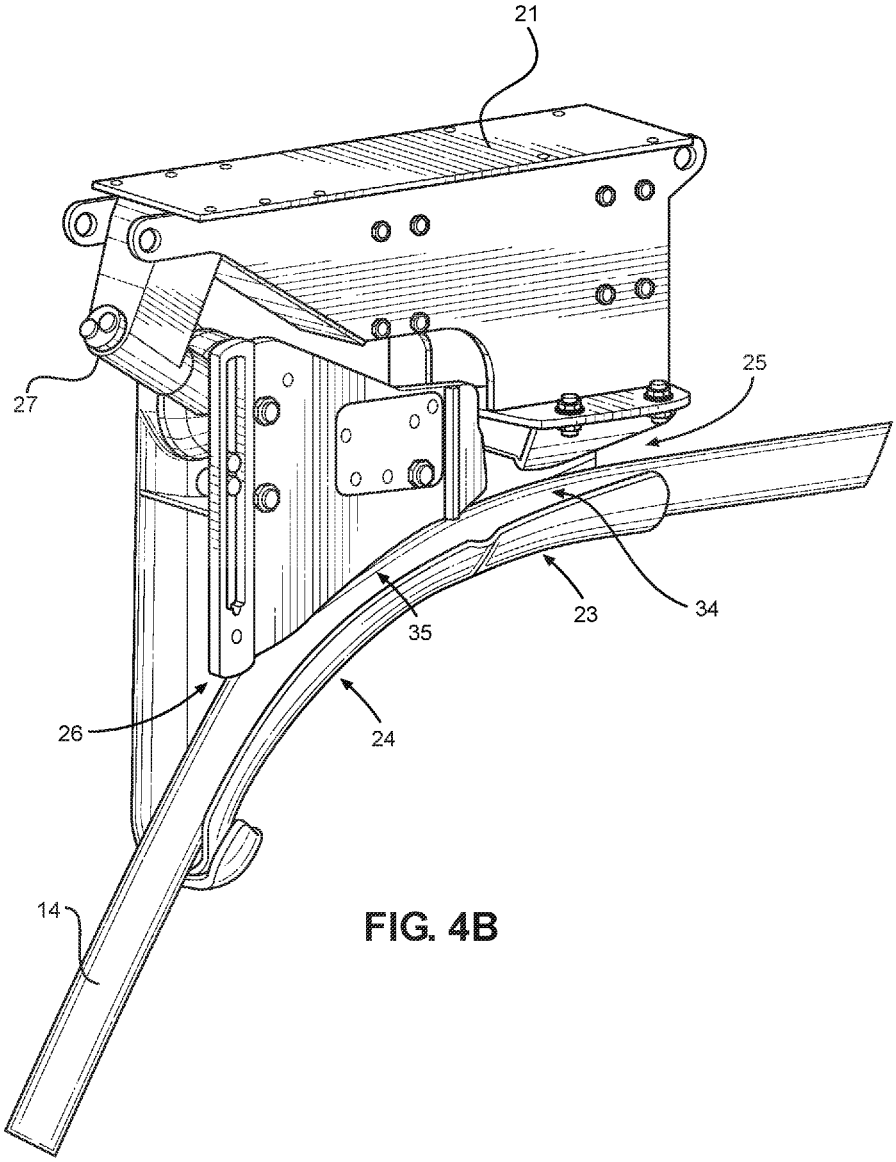
Figure 4C:
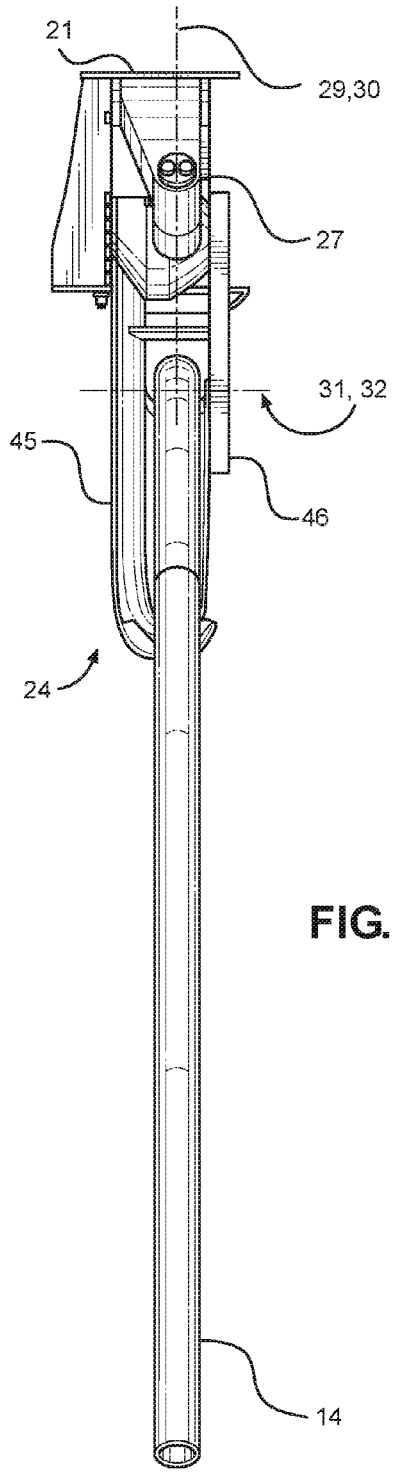
Figure 5:
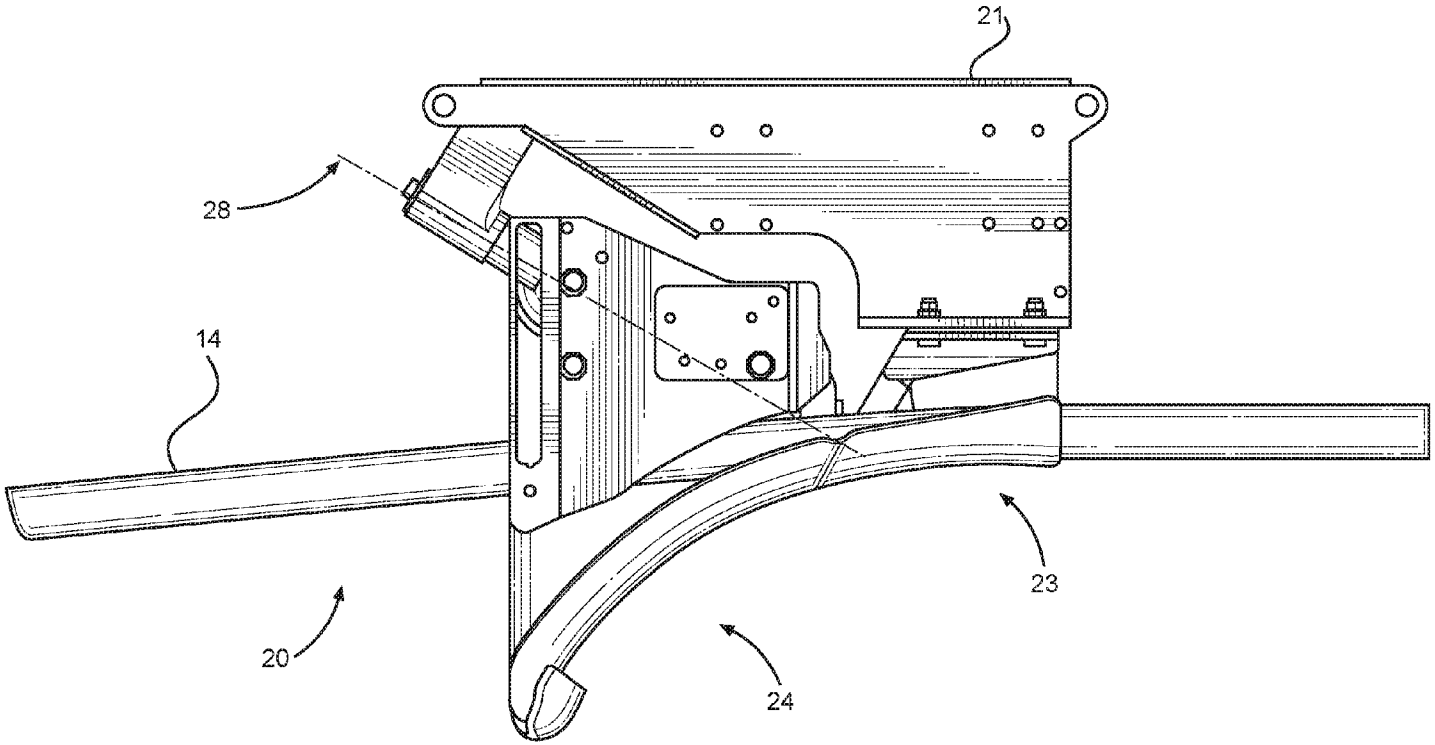
FIG. 5 schematically represents, in side view, a cable passing into the fairlead when towing at high speed, FIGS. 6*a*, 6*b* schematically represent a part of the fairlead of the device according to the invention, in perspective (FIG. 6*b*) and in front view (from the sea side), when the pivoting segment is in a port side position (FIG. 6*c*)

The change of direction lies between 45° and 90° in FIGS. 4*b* and 4*c*. This arrangement makes it possible to switch the cable 14 from a first direction substantially horizontal to the ship 10 to a second direction forming a lesser angle with the vertical, which is, here, between 45° and 90°. The first horizontal direction is for example the one that the cable 14 assumes upstream of the fairlead 20, between the reel 18 and the fairlead 20. The second direction is, for example, the one that the cable 14 assumes downstream of the fairlead 20, when the cable 14 enters into the water. A change of direction of 90° is obtained when the ship 10 is stopped or when the towed body is submerged. The cable 14 therefore dips into the water vertically. When the ship 10 picks up speed, the cable 14 is inclined to reduce the inclination of the change of direction as can be seen in FIG. 5 in which the direction of the cable 14 in the plane of the sheet is substantially the same upstream and downstream of the fairlead 20.

According to the invention, the pivoting sector 24 is articulated relative to the ship 10 in order to allow a certain amplitude of change of direction of the cable 14 when the ship 10 changes heading. Such an articulation allows for a good guidance of the cable 14 all along the length of the fairlead 20, in particular on the side of the marine environment, and makes it possible to limit the stresses in the cable and the antenna when they are being guided along the fairlead, in particular in the case of a change of heading of the ship 10.

More specifically, the fairlead 20 comprises an articulation 27 with a degree of freedom in rotation about an axis 28, allowing the rotation of the pivoting sector 24 relative to the frame 21. The fixed sector 23 is secured to the frame 21. An articulation having a degree of freedom in rotation is also called pivot link. In the embodiment of the figures, the articulation 27 links the sector 24 and the frame 21. The frame 21 can be fixed onto the ship 10, for example onto a deck of the ship such as the rear platform 19 or onto a wire guide allowing for the correct stowing of the cable 14 on the reel 18. The axis 28 is contained, in the nonlimiting embodiment of the figures, in a first plane 29 comprising a first main direction in which the cable can extend in the fixed sector 23. The first plane 29 is the plane of FIG. 4*a* which is also shown in FIG. 4*c*. The main direction at a point of the sector is the main direction in which the fixed sector 23 is intended to guide the cable 14 at the corresponding point of the sector. It is also the direction in which the axis of the cable passes, which cable is guided within this sector at the corresponding point of the sector 23.

The axis 28 is also contained in a second plane 30 comprising a second main direction in which the cable 14 can extend in the pivoting sector 24. This second main direction is the main direction in which the second sector 23 is intended to guide the cable 14 at a point of the sector 24. It is also the direction in which the axis of the cable 14 which is guided within this sector passes, at the corresponding point of the sector 24 when the loads exerted on the cable on either side of the fairlead are situated in a plane. The pivoting sector 24 is then in its position of equilibrium.

The sectors 23, 24 are arranged such that the planes 29, 30 coincide, when the pivoting sector 24 is in a position of equilibrium. The second sector 24 occupies the position of equilibrium represented in FIGS. 4*a*, 4*b*, 4*c*, when the loads to which the cable 14 is subjected upstream and downstream of the fairlead are situated in a same plane. Such is notably the case when the ship follows a constant heading. In other words, the first and second channels 25, 26 are configured and arranged so as to guide the cable in the first plane 29 when the pivoting sector 24 occupies its position of equilibrium, also called position of rest.

Figure 6A:
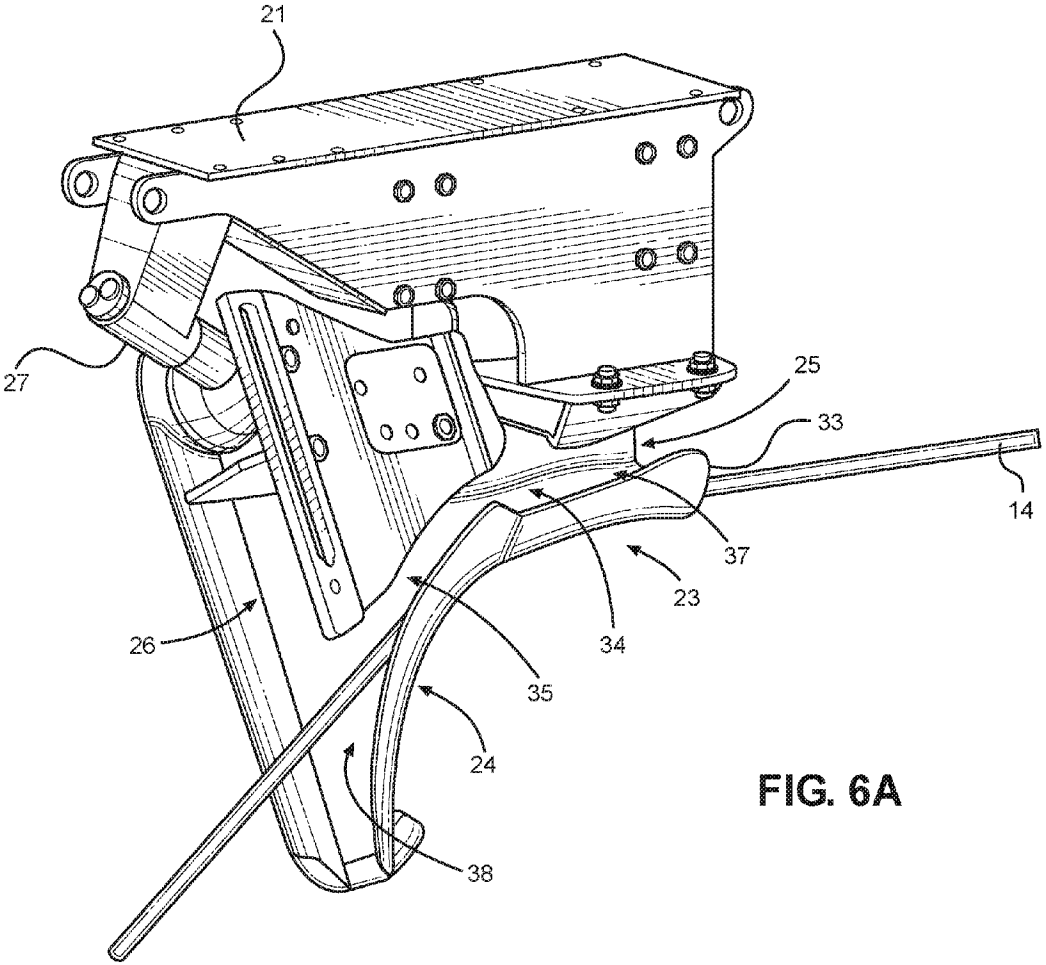
Figure 6B:
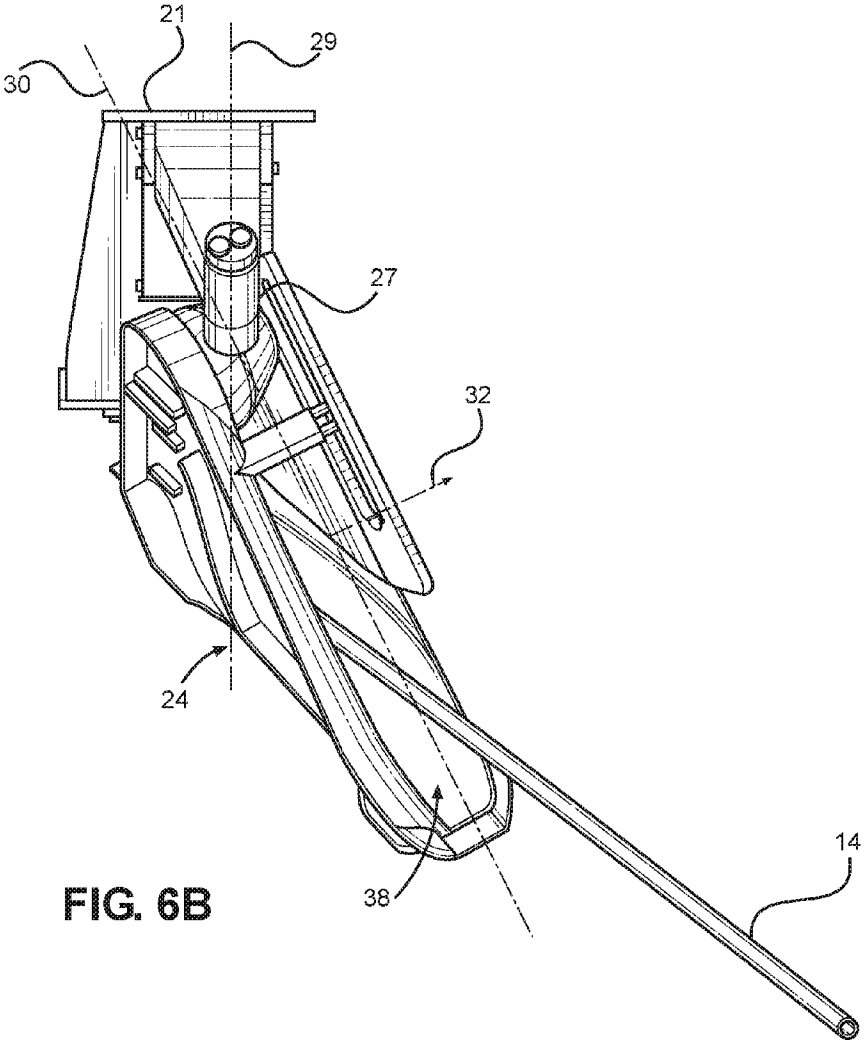

The second plane 30 can be inclined relative to the first plane 29, notably when the ship 10 alters its heading. The inclination of the plane 30 is obtained when the articulation 27 pivots. The pivoting sector 24 pivots about the articulation 27 as a function of the direction of the loads exerted on the cable 14, on either side of its position of equilibrium. In FIGS. 6*a* and 6*b*, the pivoting sector is located outside of its position of equilibrium and has pivoted toward starboard relative to its position of equilibrium. Generally, the sectors are arranged such that the second plane 30 is a vertical plane of the ship when the first sector is in its position of equilibrium. The second plane 30 is inclined relative to a vertical plane of the ship when the articulation 27 pivots, for example, upon a change of heading. This vertical plane is, in the embodiment of the figures, the first plane 29 comprising the first direction in which the cable can extend in the first sector but could be another vertical plane.

According to the invention, the fixed sector 23 is interposed between the pivoting sector 24 and the winch 16. The fixed sector 23 guides the cable 14 in the plane 29. The fixed sector 23 therefore makes it possible to control the direction of the cable 14 where it leaves the fairlead 20 on the winch 16 side. For the turns to be well wound onto the reel contiguously, it is necessary to minimize and control the angle that the cable 14 forms with a plane at right angles to the axis of the reel on leaving the fairlead on the winch 16 side. The invention makes it possible, for example, to guarantee that this angle is zero by simply positioning the fixed sector 23 such that the plane 29 is at right angles to the axis of rotation of the reel 18, in the case where the fairlead is secured to the wire guide. The device according to the invention is therefore compact, there is no need to provide a significant distance between the reel and the fairlead to reduce any lateral clearance angle of the cable on leaving the fairlead on the winch side or to provide a complex wire-guiding device slaved to the angle formed by the pivoting sector about the axis 28, relative to its position of equilibrium. The device according to the invention makes it possible to easily manage the position of the cable 14 between the fairlead 20 and the winch 16 and thus avoid the problems of poor winding of the turns of the cable 14 on the reel 18 while being compact. The fixed segment 23 also makes it possible to limit the sharp angles which could damage the cable 14 on leaving the fairlead 20 on the winch side which also contributes to the compactness of the device.

The channels 25, 26 extend all along the sectors 23, 24 in the first and second main directions. They are open laterally, that is to say that they are open along axes 31, 32 at right angles to the respective planes 29, 30. In other words, they are open along axes 31, 32 at right angles to the first plane 29 when the pivoting sector is in its position of equilibrium. The plane 30 oscillates about the axis 28 with the pivoting sector 24. The first plane 29 is a vertical plane. The vertical and horizontal directions are defined relative to a plinth 201 of the frame 1 defining a plane intended to be parallel to the plane of the platform 19, that is to say to the deck of the ship, when the frame 21 is placed on this platform.

Figure 7A:
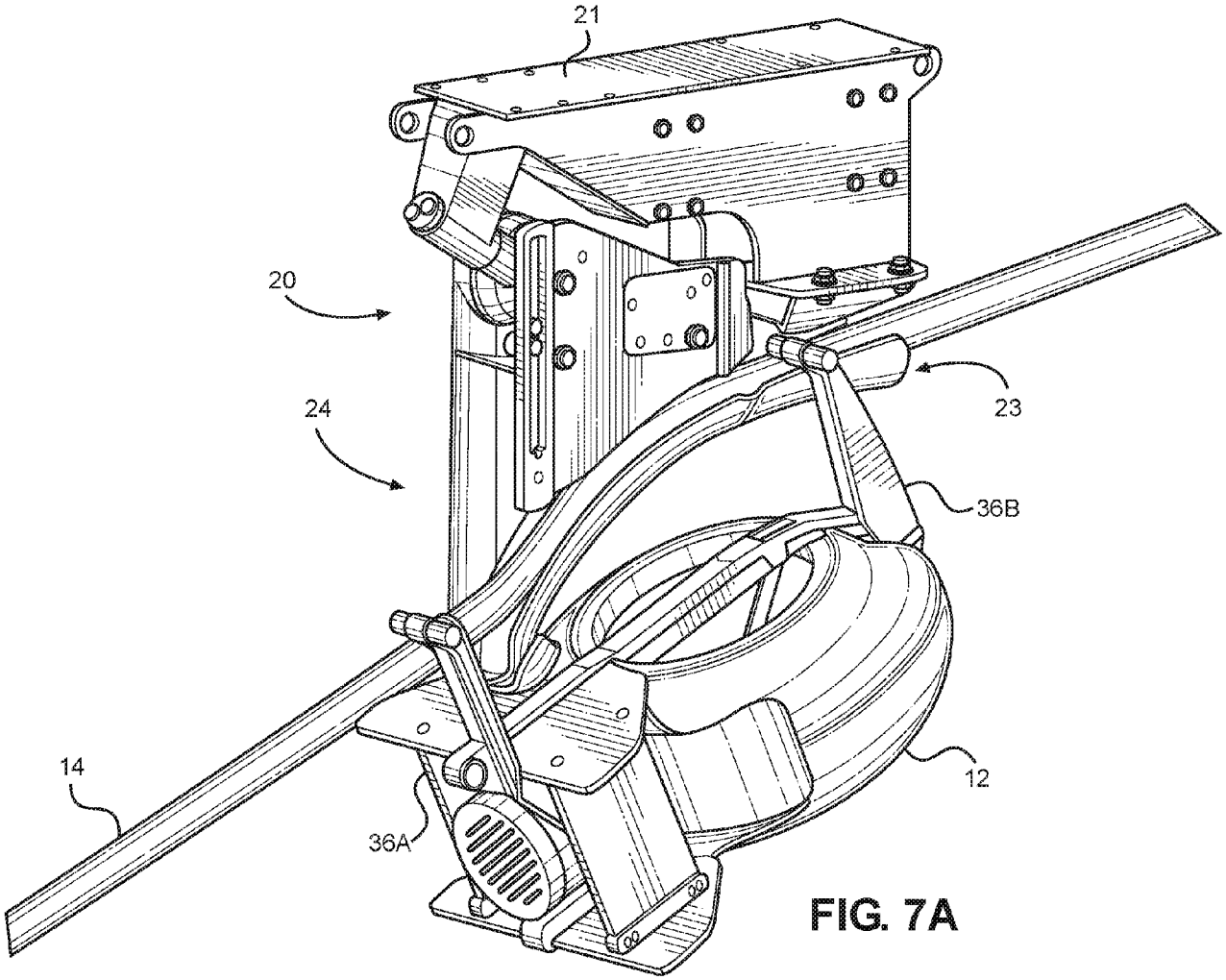
FIGS. 7*a* and 7*b* represent two phases of passage of the towed body in the fairlead, in perspective (FIG. 7*a*) and in side view (FIG. 7*b*)
Figure 7B:
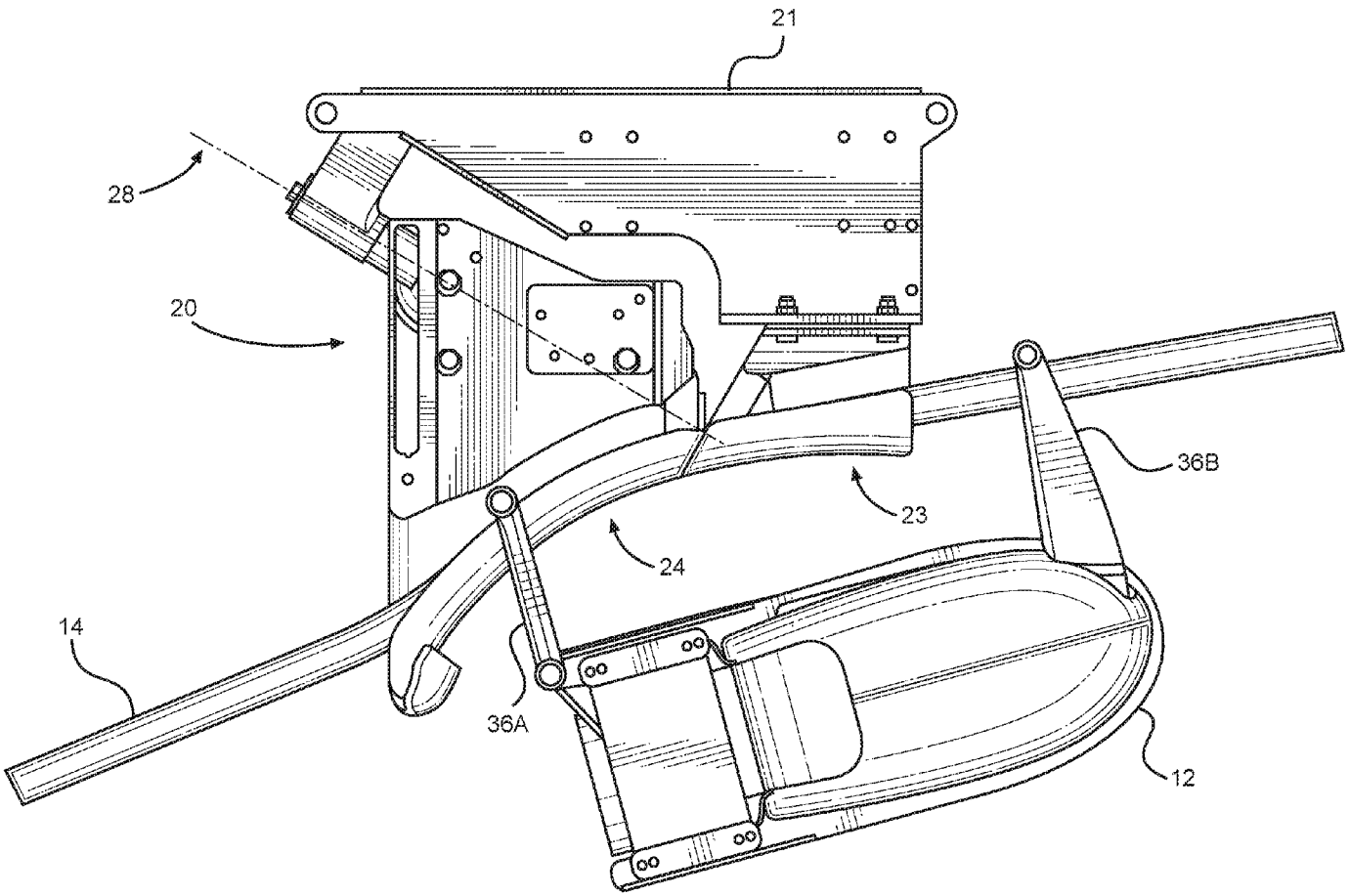
Figure 10A:
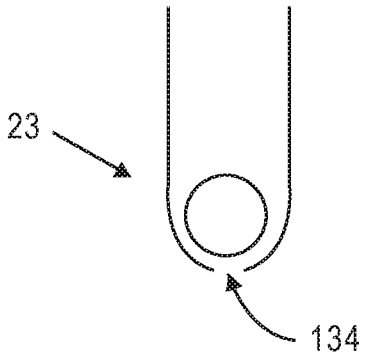
FIGS. 10*a* and 10*b* schematically represent an opening in first and second sectors toward the bottom of the fairlead.
Figure 10B:
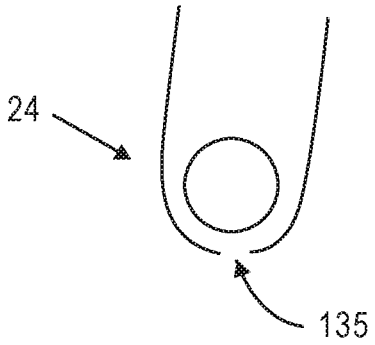

The channel 25 has a section in the form of a C that is open, that is to say emerging, laterally. The channel 26 is, here, a groove formed in a profiled body 33 referenced in FIG. 6 *a*. The openings 34, 35 are above all intended to allow a fixing 36 *a*, 36 *b* of the fish 12 to pass along the fairlead 20 as can be seen in FIGS. 7*a* and 7*b*. The fish 12 can thus be raised onboard the ship 10 and be unhooked from the cable between the fairlead 20 and the winch 16. The position of the fish 12 relative to the ship 10 can be perfectly known and controlled. The only parameter that can affect the position of the fish 12 is the control of the winch 16. It is thus possible to dispense with an articulated arm for maneuvering the fish onboard the ship 10, notably for attaching it to and unhooking it from the cable 14. The device according to the invention is suitable for the towing of disparate objects along a single cable. According to an exemplary variant depicted in FIGS. 10 *a* and 10 *b*, openings 134, 135 intended to allow the fixing of the fish to pass are bottom openings or else the fairlead comprises both types of openings. The channels are open on a vertical axis directed downward when the pivoting sector is in its position of equilibrium. The up and down directions are the directions going from the plinth 201 to the segments, and, respectively, downward, in a vertical direction. The bottom openings 134, 135 make it possible to avoid having the cable escape from the channels, regardless of the position of the fairlead relative to the winch, during the wire-guiding.

Figure 8:
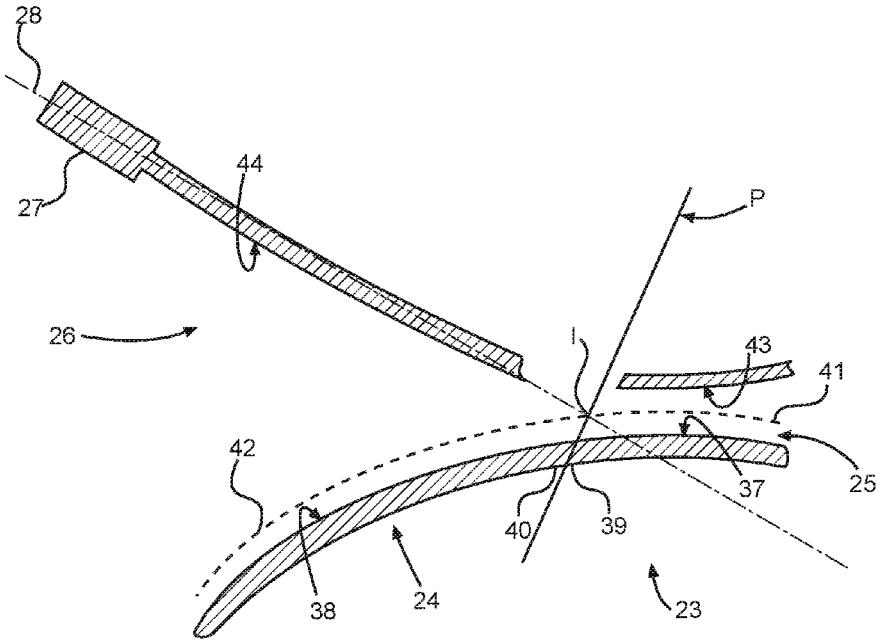
FIG. 8 represents a cross section of the two segments of the fairlead in the plane containing the axis of rotation of the pivoting segment and the first main direction when the pivoting segment is in the position of equilibrium, FIGS. 9*a* and 9*b* schematically represent the positions of the projections, in the joining plane, of the ends of the bottom bearing surfaces of the two segments when the axis cuts the joining plane at the curve formed by the centers of the sections of the bottom bearing surfaces (FIG. 9*a*) and, respectively, away from this curve (FIG. 9*b*).

In the example represented in the figures, the fixed sector 23 comprises a first bottom bearing surface 37 which can be seen in FIGS. 6*a* and 8, on which the cable 14 can rest. The pivoting sector 24 comprises a second bottom bearing surface 38 that can be seen in FIGS. 6*a* and 6*b* and 8 on which the cable 14 can rest. FIG. 8 represents the fairlead 20 in cross section in a plane passing through the axis of the cable 14 when the ship follows a substantially rectilinear heading, that is to say when the pivoting sector 24 is in its position of equilibrium. This plane is the first plane 29.

The first and the second bottom bearing surfaces 37, 38 have, in the planes 29 and 30, a first and a second curvatures centered toward the underside of the fairlead 20. These are the curvatures of the shaped curves formed by the bottoms of the first and the second bottom bearing surfaces 37, 38 along the sectors 23, 24 in the planes 29 and 30. The bottoms of the bottom bearing surfaces 37, 38 are the points of these surfaces occupying the lowest positions, in the vertical plane, when the pivoting sector is in its position of equilibrium. The bottoms of the surfaces 37, 38 are in the respective planes 29, 30.

The bottom bearing surfaces 37, 38 are dimensioned such that their curvatures, in the planes 29 and 30 have, at all points, radii of curvature at least equal to the minimum acceptable radius of curvature for the cable. The two segments 23, 24 are configured and positioned relative to one another such that the bottom bearing surface formed by the first and the second bottom bearing surfaces have a curvature of radius at least equal to the minimum acceptable radius of curvature, at least when the pivoting sector 24 is located in its position of equilibrium. The fairlead 20 thus limits the minimum curvature of the cable to a predetermined minimum value and makes it possible to avoid the sharp angles which could damage the cable on leaving the fairlead. The curvatures are not necessarily circular arcs. The bottom surface of the fixed part could, as a variant, have a flat curvature, that is to say have a bottom extending in a straight line. The radius of curvature of the bottom surface is then infinite.

Advantageously, the first bottom bearing surface 37 and the second bottom bearing surface 38 are substantially contiguous. In other words, they are contiguous to within a functional play, notably when the pivoting segment 24 occupies the position of equilibrium. The functional play is the space separating the two bearing surfaces so as to allow the first pivoting segment to pivot about the axis 28. In other words, the zone of separation between the fixed part and the pivoting part is substantially reduced to a plane P1, called joining plane.

The first bottom bearing surface 37 comprises a first end 39 and the second bottom bearing surface 38 comprises a second end 40 substantially contiguous to the first end 39. These ends 39, 40 comprise surfaces which extend substantially, that is to say to within the functional play, in the joining plane P. In other words, the first and second ends 39, 40 extend substantially along surfaces contiguous in two substantially parallel planes separated by a distance corresponding to the functional play notably when the pivoting segment is in the position of equilibrium.

Advantageously, as represented in FIGS. 4*a* and 8, the joining plane P extends substantially at right angles to the axis 28. Consequently, when the pivoting segment 24 pivots about the axis 28, the two substantially contiguous ends 39, 40 remain parallel to one another. The result thereof is that they remain spaced apart solely by the functional play. This configuration makes it possible to avoid having the two segments move too far apart when the first segment pivots.

This makes it possible to avoid having the cable, and above all the fish, fall between the two segments and also to retain a continuity of the bottom bearing surface 37, 38 even when the second sector 24 is inclined. This continuity makes it possible to avoid the risks of damage to the antenna or the cable.

The first bottom bearing surface 37 and the second bottom bearing surface 38 have semicircular sections in planes at right angles to the main directions that they define, notably in planes parallel to the joining plane P at the first and second ends 39, 40. The circular sections preferably form at least one half-circle. The bottom bearing surfaces 37, 38 thus each delimit a shaped furrow with semicircular section extending all along the sector 23, 24 concerned. Since the bottoms of the surfaces 37, 38 are situated in the planes 29, 30, they form a substantially continuous shaped surface when the pivoting segment 24 is in its position of equilibrium.

The semicircular sections have a substantially fixed radius over most of the sectors concerned 23, 24, not including the chamfering in the entry and exit zones of the sectors concerned when the ends of the sectors are chamfered and except for the entry and exit zones of the fairlead when they widen in planes parallel to the joining plane P. Chamfering the ends of the segments makes it possible to avoid any risk of damage to the cable. The constant radius makes it possible to avoid the formation of a step between the two bearing surfaces when the pivoting segment is in its position of equilibrium.

The centers of the semicircular sections of the first bottom bearing surface 37 and of the second bottom bearing surface 38 follow a first shaped curve 41 along the fixed segment 23 and, respectively, a second shaped curve 42 along the pivoting segment 24. These curves have, at each point of the corresponding segment, a radius equal to the sum of the radius of the corresponding bottom bearing surface and of the radius of the semicircular section. These shaped curves 41, 42 extend over all of the segments 23, 24 except over any chamfered end zones.

Figure 9A:
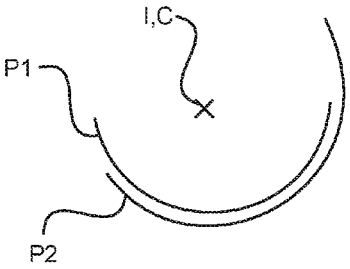
Figure 9B:
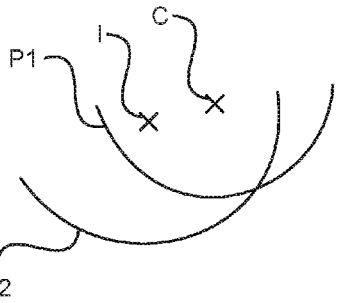

Advantageously, as can be seen in FIG. 8, the axis 28 cuts the joining plane P at a point I located substantially on the two shaped curves 41, 42. In other words, if the shaped curves 41, 42 formed by the centers of the semicircular sections 37, 38 are slightly extended, they meet in the play between the two segments 23, 24. This feature makes it possible to minimize the discontinuity between the two bottom bearing surfaces 37, 38 and avoid the formation of a step between the two bottom bearing surfaces 37, 38 upon the oscillation of the second segment. There is therefore no formation of sharp edges which could damage the cable. This is illustrated in FIGS. 9*a* and 9*b* in which are represented the projection P1 of the position of the ends 39, 40 of the bottom bearing surfaces 37, 38 on the joining plane P when the pivoting segment 24 is in its position of equilibrium (these projections coinciding), and the projection of a position P2 of the end 40 of the pivoting segment when it has pivoted about the axis 28, when the axis 28 cuts the joining plane at the point I corresponding to the intersection C of the curves 41, 42 (FIG. 9*a*) and respectively when the point I is offset from this intersection C (FIG. 9*b*). For greater clarity, the position P2 has been offset from the position P1 in FIG. 1, but they are in fact superposed and only offset by an angle formed about the point I. In the case of FIG. 9*b*, in which the axis 28 does not cut the joining plane at the intersection of the curves 41 and 42, when the fairlead oscillates, a discontinuity is formed between the bottom bearing surfaces 37 and 38.

In the embodiment of the figures, the second bottom bearing surface 38 is advantageously of a single piece. It can be formed from a single piece or a set of parts secured to one another. This feature, by limiting the number of parts moving relative to one another, makes it possible to obtain a reliable and inexpensive device. As a variant, the second bottom bearing surface 38 is formed from a plurality of mutually mobile bottom bearing surfaces. They are for example articulated by means of articulations with a degree of freedom in rotation about axes substantially at right angles to the second plane 30.

Advantageously, as can be seen in FIG. 8, the channel 26 formed in the second sector 24 has a flared form in the second plane 30 comprising the axis 28 and a second direction, for example the second main direction, in which the cable 14 can extend in the second sector 24, the channel 26 widening in the direction from the second segment 24 to the first segment 23. This configuration makes it possible to accept the modification of the curvature of the cable when the towing speed varies by limiting the loads applied to the cable.

Advantageously, the pivoting sector 24 comprises a second top bearing surface 44 against which the cable can bear. The second top bearing surface 44 can be substantially planar. Preferably, as can be seen in FIG. 8, the second top bearing surface 44 has an inverted curvature, in the second plane 30, relative to that of the second bottom bearing surface 38, that is to say centered toward the top of the fairlead. The top bearing surfaces 43, 44 are dimensioned and arranged so as to guarantee that the curvature of the cable, when the cable is curved toward the top of the fairlead, has a radius of curvature at least equal to the minimum radius of curvature. The cable 14 can come to bear on these two top bearing surfaces 43, 44. The heights are defined in the vertical direction defined relative to the plinth 201. Thus, loads are prevented from being exerted on the cable in the pivoting part of the fairlead during tows at high speed are thus limited. The top and bottom bearing surfaces can have semicircular sections in cutting planes parallel to the joining plane P.

The semicircular sections of the bottom and top bearing surfaces are centered toward the interior of the channels 25, 26.

Advantageously, as represented in FIG. 3, the lateral opening 34 formed in the fixed sector 23 extends substantially in the extension of one of the two flanges 109 of the reel 18, the opening 34 being oriented along the axis 31 in a direction moving away from the other flange 108 of the reel 18 such that a cable 14 passing into the fairlead 20 cannot escape from the channel through the opening 34 during the wire-guiding or cannot be deflected by the opening 34 during the wire-guiding. In other words, the channel 25 is open toward the flange 109. The opening 34 forms the side of the fixed part 23 located in the extension of the flange 109.

For example, in FIG. 3, the channel 25 is open toward the starboard side, so the opening 34 is positioned aligned with the starboard flange 109 of the reel 18 in order to never have any deflection of the cable 14 between the fairlead 20 and the reel 18 on the starboard side during the winding of the various layers of cable on the reel 18. This feature makes it possible to avoid deflections of the cable between the fairlead and the reel. This configuration can be adopted for any type of fairlead, oscillating with or without fixed sector, fixed, articulated having a channel suitable for receiving the cable, having a lateral opening. These configurations are not claimed.

The second bottom 38 and top 44 bearing surfaces of the pivoting segment 24 are linked or separated on each side by walls 45, 46 referenced in FIG. 4*c*. The wall 26 is linked to the bottom bearing surface 38 via the opening 35 or else the wall 26 comprises the opening 35. These walls 45, 46 are, for example, vertical when the pivoting segment 24 is in its position of equilibrium. The distance between these walls is chosen so as to allow the cable diameters that can be received in the channels delimited by the bottom bearing surfaces 37, 38 to pass, the cables being able to come to bear against these walls when the pivoting segment 24 pivots.

In an unclaimed embodiment, different from the prior art, the fairlead has no sector secured to the frame. It comprises a pivoting sector linked to the frame by means of an articulation with a degree of freedom allowing the rotation of the sector relative to the frame about an axis contained in a plane comprising a first direction in which the cable can extend in this sector.

The invention claimed is:

1. A towing device configured to equip a deck of a ship, the towing device comprising:

a winch;

a cable;

a fairlead configured to circulate the cable in the fairlead under an action of the winch, the fairlead comprising a frame and first and second sectors, the first and second sectors having a channel configured to guide the cable; and an articulation configured to allow the second sector to rotate relative to the frame about an axis contained in a plane comprising a direction in which the cable can extend in the second sector, wherein the first sector is secured to the frame between the winch and the second sector, the first sector comprises a first bottom bearing surface having a first end, the second sector comprises a second bottom bearing surface having a second end, and the cable is configured to come to rest on said first and second bearing surfaces in direct physical contact with said first and second bearing surfaces, and said first and second ends form surfaces extending substantially parallel to each other and are separated by a joining plane (P) extending substantially at right angles to the axis.

2. The device of claim 1, wherein the first bottom bearing surface and the second bottom bearing surface have semicircular sections, and the axis cuts the joining plane (P) at a point located on a first shaped curve and a second shaped curve formed by centers of the semicircular sections of the first bottom bearing surface and the second bottom bearing surface.

3. The device of claim 1, wherein said second bottom bearing surface is a single piece.

4. The device of claim 1, wherein the channel of the second sector has a flared form in the plane comprising the axis and the direction in which the cable can extend in the second sector, the channel of the second sector widening in the direction from the second sector to the first sector.

5. The device of claim 1, wherein the channels of said first and second sectors are laterally open.

6. The device of claim 1, wherein the channels of said first and second sectors are open toward the bottom of the fairlead.

7. The device of claim 1, further comprising:

a wire-guiding device configured to pass the cable, the wire-guiding device being interposed between the fairlead and the winch, wherein the winch comprises a reel having a drum delimited by first and second flanges, the channel of the first sector having a lateral opening extending substantially in alignment with the first flange, the lateral opening being oriented in a direction moving away from the second flange.

8. The device of claim 1, wherein the axis is contained in a first plane comprising a direction in which the cable can extend in the first sector.

9. The device of claim 1, wherein the first bottom bearing surface and the second bottom bearing surface have circular sections and the axis cuts the joining plane (P) at a point located on a first shaped curve and a second shaped curve formed by centers of the circular sections of the first bottom bearing surface and the second bottom bearing surface.

10. A towing device configured to equip a deck of a ship comprising:

a winch;

a cable;

a fairlead configured to circulate the cable in the fairlead under an action of the winch, the fairlead comprising a frame and first and one second sectors, the first and second sectors having a channel configured to guide the cable; and an articulation configured to allow the second sector to rotate relative to the frame about an axis contained in a plane comprising a direction in which the cable can extend in the second sector, wherein the first sector is secured to the frame between the winch and the second sector, the first sector comprising a first bottom bearing surface having a first end, the second sector comprises a second bottom bearing surface having a second end, said cable is configured to rest on said first and second bearing surfaces, and said first end and said second end form surfaces extending substantially in a joining plane (P), the joining plane (P) extending substantially at right angles to the axis, the axis being inclined relative to a vertical direction at a right angle to a plane of the device configured to be parallel to the deck of the ship.

11. The towing device of claim 10, wherein the first bottom bearing surface and the second bottom bearing surface have semicircular sections, and the axis cuts the joining plane (P) at a point located on a first shaped curve and a second shaped curve formed by centers of the semicircular sections of the first and second bottom bearing surfaces.

12. The towing device of claim 10, wherein the second bottom bearing surface is a single piece.

13. The towing device of claim 10, wherein the channel of the second sector has a flared form in the plane comprising the axis and the direction in which the cable can extend in the second sector, the channel of the second sector widening in the direction from the second sector to the first sector.

14. The towing device of claim 10, further comprising:

a wire-guiding device configured to pass the cable, the wire-guiding device being interposed between the fairlead and the winch, wherein the winch comprises a reel having a drum delimited by first and second flanges, the channel of the first sector having a lateral opening extending substantially in the alignment with the first flange, the lateral opening being oriented in a direction moving away from the second flange.

15. The towing device of claim 10, in which the first bottom bearing surface and the second bottom bearing surface have circular sections and in which the axis cuts the joining plane (P) at a point located on a first shaped curve and a second shaped curve formed by centers of the circular sections of the first bottom bearing surface and, respectively, of the second bottom bearing surface.

16. A towing device configured to equip a deck of a ship, the towing device comprising:

a winch having a reel comprising a drum delimited by first and second flanges;

a cable;

a fairlead configured to circulate the cable in the fairlead under an action of the winch, the fairlead comprising at least one sector, the at least one sector having a channel configured to guide the cable; and a wire-guiding device configured to pass the cable, the wire-guiding device being interposed between the fairlead and the winch, wherein the channel of the at least one sector comprises a lateral opening extending substantially in the alignment with the first flange, and the lateral opening is oriented in a direction moving away from the second flange.

17. The towing device of claim 16, wherein the fairlead comprises a frame, and the at least one sector includes first and one second sectors, the first and second sectors having a channel configured to guide the cable, and the towing device further comprises:

an articulation configured to allow the second sector to rotate relative to the frame about an axis contained in a plane comprising a direction in which the cable can extend in the second sector; and a wire-guiding device configured to pass the cable, the wire-guiding device being interposed between the fairlead and the winch, wherein the winch comprises a reel having a drum delimited by first and second flanges, the channel of the first sector having a lateral opening extending substantially in the alignment with the first flange, the lateral opening being oriented in a direction moving away from the second flange.

18. The towing device of claim 17, wherein the first sector is secured to the frame between the winch and the second sector, the first sector comprises a first bottom bearing surface having a first end, the second sector comprises a second bottom bearing surface having a second end, said cable can rest on said first and second bearing surfaces and said first end and said second end form surfaces extend substantially in a joining plane (P), the joining plane being substantially at right angles to the axis.

19. A towing device configured to equip a deck of a ship, the towing device comprising:

a winch;

a cable;

a fairlead configured to circulate the fairlead under an action of the winch, the fairlead comprising a frame and first and second sectors, the first and second sectors having a channel configured to guide the cable; and an articulation configure to allow the second sector to rotate relative to the frame about an axis contained in a plane comprising a direction in which the cable can extend in the second sector, wherein the first sector is secured to the frame between the winch and the second sector, the first sector comprises a first bottom bearing surface having a first end, the second sector comprises a second bottom bearing surface having a second end, said cable configured to bear on said first and second bearing surfaces, the first and second ends forming surfaces extending substantially in a joining plane (P), the joining plane extending substantially at right angles to the axis, the first bottom bearing surface and the second bottom bearing surface having circular sections and in which the axis cuts the joining plane (P) at a point located on a first shaped curve and a second shaped curve formed by centers of the circular sections of the first bottom bearing surface and the second bottom bearing surface.

20. The towing device of claim 19, wherein the first bottom bearing surface and the second bottom bearing surface have semicircular sections, and the axis cuts the joining plane (P) at a point located on a first shaped curve and a second shaped curve formed by the centers of the semicircular sections of the first bottom bearing surface and the second bottom bearing surface.

21. A towing device configured to equip a deck of a ship, the towing device comprising:

a winch;

a cable;

a fairlead configured to circulate the cable under an action of the winch, the fairlead comprising a frame and first and second sectors, the first and second sectors having a channel configured to guide the cable; and an articulation configured to allow the second sector to rotate relative to the frame about an axis contained in a plane comprising a direction in which the cable can extend in the second sector, wherein the first sector is secured to the frame between the winch and the second sector, the first sector having a first bottom bearing surface having a first end, the second sector comprises a second bottom bearing surface having a second end, said cable being able to rest on said first and second bearing surfaces, and the first end and the second end form surfaces extending substantially in a joining plane (P), the joining plane (P) being substantially at right angles to the axis, each of the first bottom bearing surface and the second bottom bearing surface forming shaped curves along the sectors the first sector and the second sector.

* * * * *